United States Patent [19]

Held

[11] Patent Number: 4,548,133

[45] Date of Patent: Oct. 22, 1985

[54] DEVICE FOR APPLICATION OF SURFACE PRESSURE IN DUAL BELT PRESSES

[76] Inventor: Kurt Held, Alte Strasse 1, D-7218 Trossingen 2, Fed. Rep. of Germany

[21] Appl. No.: 637,322

[22] Filed: Aug. 1, 1984

Related U.S. Application Data

[63] Continuation of Ser. No. 386,112, Jun. 7, 1982, abandoned.

[30] Foreign Application Priority Data

Jun. 12, 1981 [DE] Fed. Rep. of Germany ..... 3123291

[51] Int. Cl.[4] ..... B30B 5/06

[52] U.S. Cl. ..... 100/153; 156/583.5; 425/371

[58] Field of Search ..... 100/151, 152, 153, 154, 100/118–120; 156/583.5; 186/26, 31, 32; 193/35 R, 35 J; 425/37, 371; 198/500; 308/203, 207 R, 215, 187, 187.1, 187.2; 384/397, 399, 152, 153, 147

[56] References Cited

U.S. PATENT DOCUMENTS

| | | | |
|---|---|---|---|
| 1,764,456 | 6/1930 | Mantius | 100/154 X |
| 2,513,860 | 7/1950 | Gordon | 308/203 |
| 2,867,481 | 1/1959 | Hornbostol | 308/187 |
| 3,642,335 | 2/1972 | Takahashi | 308/187.1 |
| 3,797,609 | 3/1974 | Bertaud | 384/397 X |
| 3,840,102 | 10/1974 | Dawson | 193/35 R |
| 4,043,732 | 8/1977 | Ahrweiler | 100/151 |
| 4,383,882 | 5/1983 | Held | 100/153 |

FOREIGN PATENT DOCUMENTS

| | | | |
|---|---|---|---|
| 1004368 | 8/1957 | Fed. Rep. of Germany . | |
| 2037442 | 2/1972 | Fed. Rep. of Germany . | |
| 2157746 | 7/1973 | Fed. Rep. of Germany . | |
| 2735142 | 2/1979 | Fed. Rep. of Germany . | |
| 2853285 | 6/1979 | Fed. Rep. of Germany . | |
| 9987 | 1/1909 | France | 100/153 |
| 327433 | 3/1958 | Switzerland . | |

OTHER PUBLICATIONS

Held International, 178 and 166, System Brochure (Exhibit A); (Exhibit B); (Exhibit C).

*Primary Examiner*—Peter Feldman

*Attorney, Agent, or Firm*—Toren, McGeady, Stanger, Goldberg & Kiel

[57] ABSTRACT

In a dual band press assembly which includes an upper and a lower press band unit each having endless press bands in driven engagement about a pair of rotative guide cylinders, there is provided a roller assembly unit which consists of a plurality of longitudinal support beams having spindles extending therebetween to mount pressure rollers which apply pressure to the inner surfaces of said endless press bands with a support plate being provided in the roller assembly unit extending thereacross on a side of the rollers opposite the side on which they engage the endless press bands. The rollers are provided with bearing needles to fill out the entire space of the rollers and of the same length as the rollers and the rollers are arranged on their axes spaced apart in rows a distance somewhat greater than the roller diameter with adjacent roller rows having rollers offset relative to each other.

6 Claims, 5 Drawing Figures

DEVICE FOR APPLICATION OF SURFACE PRESSURE IN DUAL BELT PRESSES

This is a continuation of application Ser. No. 386,112, filed June 7, 1982, now abandoned.

The present invention relates generally to devices for application of surface pressures onto endlessly revolving press bands and more particularly at double band presses.

When applying high surface pressures onto press bands which revolve endlessly around cylinders, and more particularly in double band presses, problems arise because it is necessary to exercise a uniform surface pressure on the reverse side of the press bands in order to make possible the satisfactory and continuous manufacturing of layered materials or laminates. A number of suggestions have been made in the prior art in order to achieve a solution to this problem. However, these suggestions have been found somewhat complicated in part and they involve considerable disadvantages thereby rendering such solutions unsatisfactory.

In the prior art, German Offenlegungsschrift No. 20 37 442 describes a press which operates with an endless band and counterband to continuously produce molded or pressed materials. The press of this prior art reference is characterized in that support of the bands is achieved by means of a series of interacting rollers which are rotatable about an axis which is perpendicular to the direction of movement of the bands. Furthermore, there is provided means for adjustment of the gap between the two rows of rollers and for adjustment of a force which prestresses the two rows of roller elements against a movement which tends to push them apart, so that the two rows of roller elements may be adjusted to an object which lies between the endless bands.

Additionally, there is known from German Auslegeschrift No. 1 004 368 a continuously operating band press having at least one band which is flexible, endless and which preferably consists of steel and serves to transfer pressure to the material to be pressed. This device operates with loose roller bodies which are closely adjoining and which also serve to transfer pressure onto the band. A characteristic feature of this press is that the roller bodies are provided with cylindrically expanding collars and are offset in their longitudinal directions always by the spacing of one collar and are arranged to engage into one another in a comb-like manner in such a way that they are at least in close contact with the end faces of the expanding collars.

A further prior art reference, German Pat. No. 2 157 746, describes a press which is utilized to apply surface pressure onto a longitudinal section of a forwardly moving web, and which particularly involves a press for the continuous manufacturing of wood chip boards and similar materials. In this device, the web is guided between endless shaping bands which revolve in correspondence to the advancing direction of the web and which extend over the widths of the web. Between the shaping bands and a supporting structure which is provided above and below the web, rollers are provided which endlessly rotate in the longitudinal plane perpendicularly with respect to the web. These rollers transfer the operating pressure from the supporting structure to the shaping bands with the rollers being divided, in relation to the web widths, into a plurality of short rollers and are connected in a chain-like fashion with one another and are provided with a separate guide means.

This press is characterized in that the roller chain arrangement is constructed to comprise many roller chains which are closely adjoining transversely with respect to the webs and which have a constant width in the forward travel direction. The roller chains form individual strands which are independent of one another. Each roller chain contains several rollers which are located side-by-side with tongues being arranged exclusively therebetween with junction points of two adjoining rollers containing tongues which are laterally offset within each roller chain in the direction of forward movement.

Swiss Pat. No. 327 433 discloses a device for effecting continuously progressive pressing of a plate-shaped material with two flexible, endless bands which simultaneously act as pressure surfaces and as conveyor belts. Pressure is transferred to the reverse side of the bands by roller bodies consisting of round bars which are arranged in movable chains wherein the roller bodies are shortened with respect to the width of the press bands and are located in an offset arrangement.

An additional prior art reference, German Offenlegungsschrift No. 28 53 285, relates to an arrangement for applying surface pressure onto advancing workpieces with at least one revolving press band which can be pressed to the workpiece by means of several similar rollers arranged with parallel shafts in one row, wherein the rollers are stationarily supported and are supported at roller bodies constructed as abutments at their sides which face away from the respective press band. The press of this prior art reference is characterized in that two adjoining rollers are always assigned to one or several roller bodies which are arranged on a common shaft.

German Pat. No. 27 35 142 describes a somewhat different approach toward providing a solution whereby there may be achieved a uniform pressure distribution. In this prior art reference, it is attempted to solve the problem by using a multi-layered press band which is supported by roller bodies which are arranged at pressure plates.

In addition to the disadvantages mentioned above with regard to the known arrangements, there also should be considered the fact that with double band presses equipped as indicated, it is not possible to produce molded or pressed workpieces or layered materials which have a lesser width than the press bands themselves.

Accordingly, the present invention is directed toward provision of a device for the application of surface pressure onto endlessly revolving press bands, and particularly at double band presses, with which it may be possible to simultaneously produce layered products or laminated products which may have any selected width within the width of the press band without requiring special or additional equipment.

SUMMARY OF THE INVENTION

Briefly, the present invention may be described as a dual band press assembly comprising: an upper and a lower press band unit each comprising a pair of rotative guide cylinders and an endless press band arranged in driven engagement about each of said pair of guide cylinders; said press band units being arranged one above the other with said endless press bands having inner surfaces engaged about said guide cylinders and outer surfaces arranged to move in pressing engagement with each other, said outer surfaces of said press band being particularly adapted to apply surface pressure to workpieces passing therebetween; roller assembly means provided in each of said upper and lower press band units for aplying surface pressure to said endless press bands against said inner surfaces thereof; said roller assembly means comprising a plurality of longitudinal support means arranged adjacent and parallel to each other, a plurality of spindles mounted to extend between said support beams, pressure rollers arranged to be in direct contact with said inner surfaces of said endless press bands on one side of said roller assembly means, said spindles having said rollers rotatively mounted thereon and defining generally parallel axes of rotation for said rollers, said rollers being mounted in rows extending between each pair of said longitudinal support beams with each of said rows having rollers arranged offset relative to each next adjacent row and a support plate extending across said roller assembly means provided on a side thereof opposite the side on which said rollers contact said inner surfaces of said endless press bands.

The assembly is formed with needle bearings mounting the rollers on the spindles with the needle bearings being configured to fill out the entire space of the rollers and being of the same length as the length of the rollers. The rollers are arranged on their rotational axes spaced apart in a direction perpendicular to their rotational axes a distance which is somewhat greater than the roller diameter.

The roller assembly means of the invention is such that the bending stresses and Hertzian pressures which occur during operation of the machine, particularly in the endless bands, do not exceed the boundary values required for prolonged-alternating-stress strength of the band materials which are utilized.

The spindles upon which the rollers are mounted may be continuous in length or they may be formed as split spindles.

In accordance with a more specific aspect of the invention, the outer surface of the rollers is formed with an approximately cylindrical shape which is adjusted to the course of the bending line of the endless press bands, each of which comprise a multi-layer band, conceived as a carrier with surface load, supported by said roller with its largest diameter in such a way that along the contact line between the band and the cylindrical roller, the same Hertzian pressure prevails.

Further, in accordance with other more detailed aspects of the invention, circulating forced feed lubrication of the rolling surfaces is made possible.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
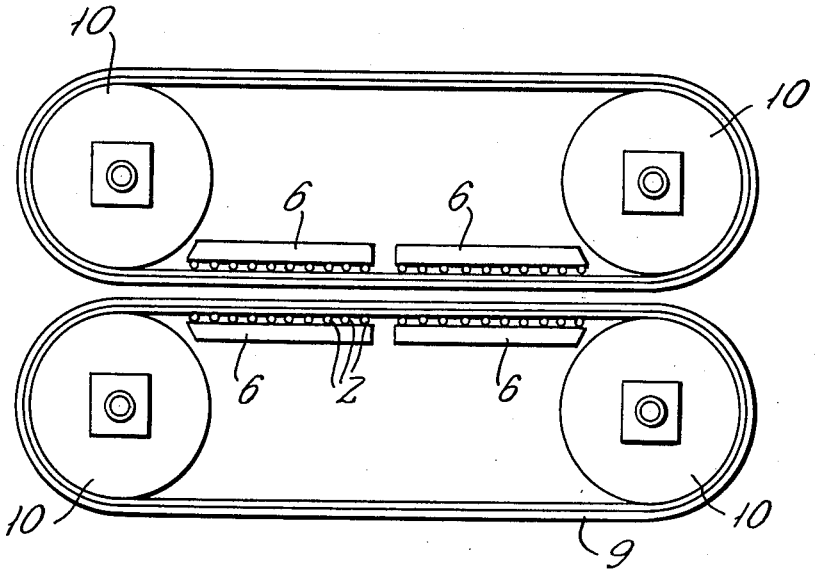
FIG. 1 is a side view of a dual band press assembly in accordance with the invention.
Figure 2:
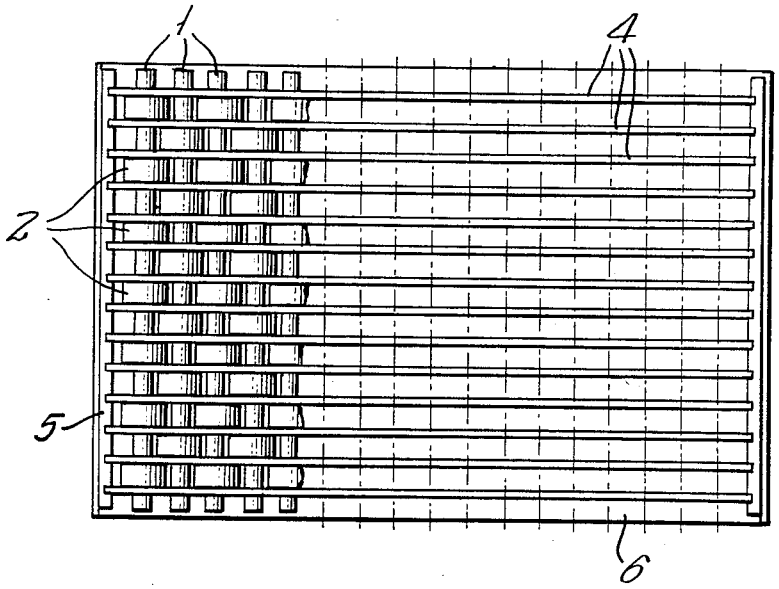
FIG. 2 is a top plan view of the roller assembly in accordance with the present invention.

Referring now to the drawings wherein there is depicted a dual band press assembly in accordance with the present invention, the overall assembly is shown in FIG. 1 as comprising a pair of endless press bands 9, which consist of multi-layer bands and which are both wound in driven engagement about a pair of guide cylinders 10. The bands 9 operate to engage therebetween workpieces such as rolled laminates for the purpose of applying pressure thereto. The assembly of FIG. 1 is equipped with roller assembly means shown as comprising a frame-like supporting element or supporting plate 6 with boundary strips 5 upon which support beams 4 are arranged. Spindles 1 pass through the support beams 4 in a direction transversely thereto. The roller assembly means operate to apply pressure to the inner surfaces of the press bands 9.

On the spindles 1 there are provided rows of rollers or roller bodies 2 which are arranged on bearing needles 3 and which are offset with respect to each other.

Due to the rollers or roller bodies 2 which run upon the bearing needles 3 and which are arranged offset in rows on continuous spindles 1, and due to the support beams 4 which are arranged between each row of roller bodies, a special strength, and particularly good bending strength, of the device is achieved whereby the bending strength makes it possible to exercise a particularly uniformly distributed surface pressure upon the endless bands 9.

The support beams 4 have hollow connecting spaces 7 by means of which a continuous supply of lubricant is provided to the roller bodies 2 which are arranged in individual rows.

The device is provided with seals 8 which may be O-rings or similar elastomers.

Figure 3:
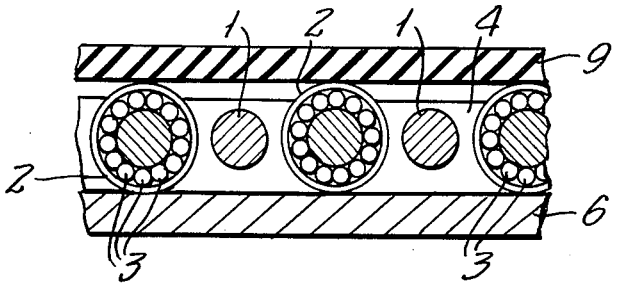
FIG. 3 is a partial sectional view of the roller assembly shown in FIG. 2.
Figure 4:
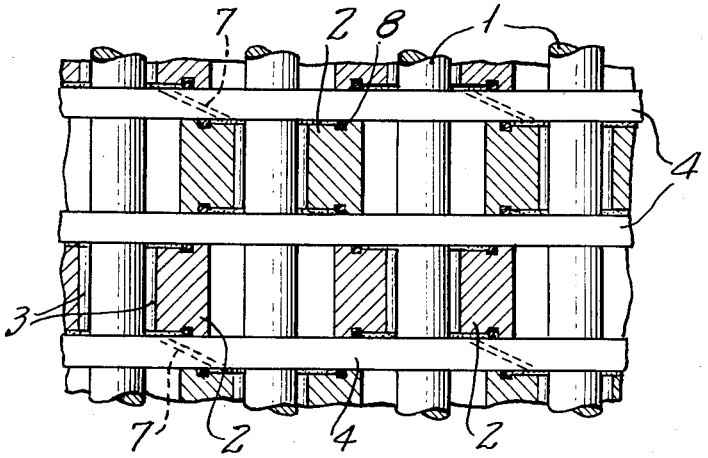
FIG. 4 is a sectional view showing the lubrication of the rollers or roller bodies.
Figure 4A:
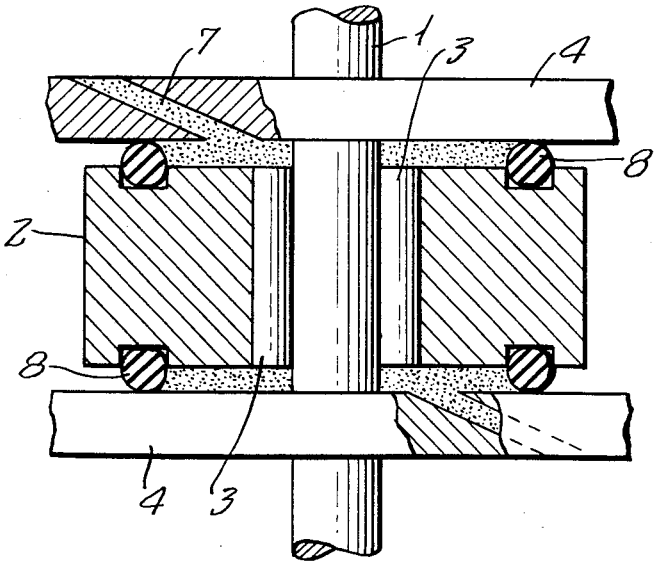

With the invention, there is provided a device for the application of surface pressure wherein there may be utilized a continuously operating press, with the invention being particularly characterized by the multi-layered bands 9 which are supported on the rollers 2 which include the bearing needles 3. The rollers are arranged so that the needles 3 fill out the entire space and are of the same length as the lengths of the rollers. Furthermore, the rollers may be arranged to roll on continuous spindles 1 and they are offset in rows. Alternatively, split spindles such as shown in FIG. 3 may be used which are themselves offset in rows. The offset of the rollers is selected to be a spacing which is somewhat greater than the radius of the rollers, but preferably smaller than the diameter of the rollers, as is shown in FIG. 4.

The rollers 2 are sealed with respect to the support beams 4 to the outside in view of the running surfaces and hollow spaced which absorb rolling motions in such a way that the bending stresses and Hertzian pressures which occur during operation of the machine, particularly in the multi-layer bands, do not exceed the boundary values which are required for prolonged-alternating-stress strength of the used band materials.

The outer surfaces of the rollers on which the multi-layer bands run have an approximately cylindrical shape which is adapted to the course of the bending line of the multi-layer band which is conceived as carrier with surface load and supported by the roller with its largest diameter in such a way that the same Hertzian pressure prevails along the contact line between the band and the cylindrical roller.

The device in accordance with the invention provides a great advantage in that onto the reverse side of the press bands a uniform surface pressure can be applied which makes a satisfactory, continuous production of layered materials of all types possible.

While a specific embodiment of the invention has been shown and described in detail to illustrate the application of the inventive principles, it will be understood that the invention may be embodied otherwise without departing from such principles.

What is claimed is:

1. A dual band press assembly comprising:

an upper and a lower press band unit each comprising a pair of rotative guide cylinders and an endless press band arranged in driven engagement about each of said pair of guide cylinders, said press band units being arranged one above the other with said endless press bands having inner surfaces engaged about said guide cylinders and outer surfaces arranged to move in pressing engagement with each other, said outer surfaces of said press bands being particularly adapted to apply surface pressure to workpieces passing therebetween; and roller assembly means provided in each of said upper and lower press band units for applying surface pressure to said endless press bands against said inner surfaces thereof, said roller assembly means comprising a plurality of longitudinal support beams arranged adjacent and parallel to each other, a plurality of spindles mounted to extend continuously between said support beams, pressure rollers arranged to be in direct contact with said inner surfaces of said endless press bands on one side of said roller assembly means, said spindles having said rollers rotatively mounted thereon and defining generally parallel axes of rotation for said rollers, said rollers being mounted in rows extending between each pair of said longitudinal support beams with each of said rows having rollers arranged offset relative to each next adjacent row, and a support plate extending across said roller assembly means provided on a side thereof opposite the side on which said rollers contact said inner surfaces of said endless press bands.

2. An assembly according to claim 1 wherein the outer surface of said rollers is formed with an approximately cylindrical shape which is adjusted to the course of said endless press bands and wherein when said rollers are arranged to apply surface pressure to said press bands they define a contact line between said band and said cylindrical rollers wherein the same Hertzian pressure prevails.

3. An assembly according to claim 1 wherein elastomeric sealing means are installed in the end faces of said rollers arranged in grooves, said elastomeric sealing means comprising roller body sheetings which are sealed toward the outside and are filled with lubricant.

4. An assembly according to claim 1 wherein hollow connecting spaces are provided in said support beams between hollow spaces of said rollers and said spindles in order to make possible a circulating forced lubrication for said rollers.

5. An assembly according to claim 1 wherein said endless press bands comprise multi-layer bands and wherein said roller assembly means is structured in such a way that the bending stresses and Hertzian pressures which occur during operation of said assembly, particularly in said multi-layer bands, do not exceed the boundary values required for the prolonged-alternating-stress strength of the band materials utilized.

6. An assembly according to claim 3 wherein said elastomeric sealing means comprise O-rings.

* * * * *